US010100710B2

(12) United States Patent
Pates et al.

(10) Patent No.: US 10,100,710 B2
(45) Date of Patent: Oct. 16, 2018

(54) DETACHABLE WATER PUMP RESERVOIR

(71) Applicant: Ford Global Technologies, LLC, Dearborn, MI (US)

(72) Inventors: Tom Pates, Manningtree (GB); Chris James Leck, Enfield (GB); Benjamin MacDonald, Romford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 536 days.

(21) Appl. No.: 14/839,382

(22) Filed: Aug. 28, 2015

(65) Prior Publication Data

US 2016/0102600 A1 Apr. 14, 2016

(30) Foreign Application Priority Data

Oct. 10, 2014 (GB) ..... 1417959.2

(51) Int. Cl.
*F01P 11/02* (2006.01)
*F01P 11/18* (2006.01)
*F01P 5/10* (2006.01)

(52) U.S. Cl.
CPC ..... *F01P 11/02* (2013.01); *F01P 5/10* (2013.01); *F01P 11/18* (2013.01)

(58) Field of Classification Search
CPC ..... F01P 11/02; F01P 5/10
USPC ..... 141/86; 415/168.1, 168.2; 137/312–314
See application file for complete search history.

(56) References Cited

U.S. PATENT DOCUMENTS 5,071,316 A * 12/1991 Diem ..... F01P 5/12 415/168.1
5,154,576 A * 10/1992 Dorski ..... F04D 29/126 277/408
5,168,626 A * 12/1992 Dorski ..... F04C 15/0046 228/2.3
5,226,786 A * 7/1993 Dorski ..... F04D 29/426 277/590
5,230,372 A * 7/1993 Westphal ..... B63B 11/04 114/343
5,338,153 A * 8/1994 Swanson ..... F04D 29/126 415/168.2
5,662,249 A * 9/1997 Grosse ..... B65D 47/147 141/319
6,446,699 B1 9/2002 Schober
(Continued)

FOREIGN PATENT DOCUMENTS

EP 1101948 A2 5/2001
EP 2063128 A1 5/2009
GB 2033979 B 9/1982
(Continued)

*Primary Examiner* — Timothy L Maust
(74) *Attorney, Agent, or Firm* — Julia Voutyras; McCoy Russell LLP

(57) ABSTRACT

A detachable water pump reservoir to collect coolant leakage from a housing of an engine water pump to which the reservoir is attached in use is described herein. The reservoir includes a hollow body defining a chamber in which the coolant leakage is collected and having a mouth shaped to complement a surface of the housing, at least one attachment apparatus configured to enable the reservoir to be easily and quickly attached to and removed from the housing of the water pump, and a level indicator to indicate the level of the coolant collected in the reservoir.

10 Claims, 4 Drawing Sheets

(56) References Cited

U.S. PATENT DOCUMENTS

| | | | | |
|---|---|---|---|---|
| 6,769,302 | B1 * | 8/2004 | King | G01F 19/00 73/426 |
| 2010/0294216 | A1 * | 11/2010 | Keene | F04D 29/106 123/41.44 |

FOREIGN PATENT DOCUMENTS

| | | | | |
|---|---|---|---|---|
| JP | 07310548 | * | 11/1995 | F01P 6/10 |
| KR | 100879058 | B1 | 1/2009 | |

* cited by examiner

DETACHABLE WATER PUMP RESERVOIR

CROSS REFERENCE TO RELATED APPLICATIONS

The present application claims priority to United Kingdom Patent Application Serial No. 1417959.2, entitled "A Detachable Water Pump Reservoir," filed Oct. 10, 2014, the entire contents of which are hereby incorporated by reference for all purposes.

FIELD

This invention relates to an engine water pump and in particular to a detachable reservoir for an engine water pump.

BACKGROUND

In an engine an engine water pump with a drain passage through which coolant that has been forced past a seal of the water pump can drain and to provide a sealed reservoir to collect such leakage may be provided. GB-B-2,033,979 for example provides such a sealed reservoir. It is a problem with such a reservoir that there is no way of emptying the reservoir if it becomes full of coolant and so the possibility for unexpected leakage of coolant exists if the reservoir becomes full.

European Patent 2,063,128 discloses a water pump in which the reservoir includes a first portion that is formed by a part of a housing of the water pump and a second portion that is fixedly attached to the housing. However, the reservoir relies on evaporation to reduce the amount of coolant therein and does not provide another mechanism for removing the fluid from the reservoir.

In one approach, a detachable water pump reservoir to collect coolant leakage from a housing of an engine water pump to which the reservoir is attached in use is provided. The reservoir includes a hollow body defining a chamber in which the coolant leakage is collected and having a mouth shaped to complement a surface of the housing, at least one attachment apparatus configured to enable the reservoir to be easily and quickly attached to and removed from the housing of the water pump, and a level indicator to indicate the level of the coolant collected in the reservoir. In this way, the reservoir can collect coolant leakage from the pump and then subsequently can be manually emptied. As a result, the likelihood of coolant leakage from the water pump into the engine is reduced, thereby improving engine operation.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

DETAILED SPECIFICATION

Figure 1:
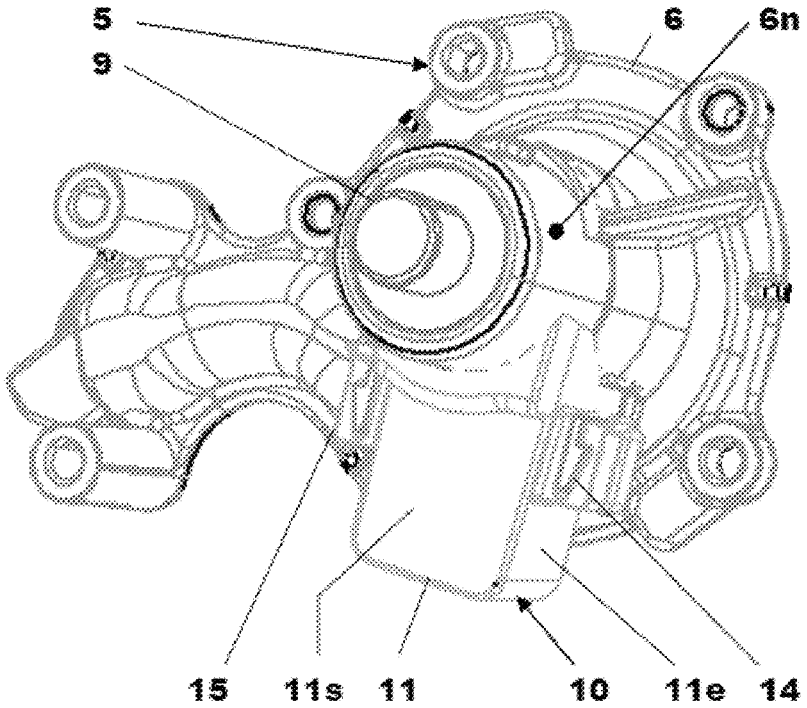
FIG. 1 is a pictorial representation of a first embodiment of an engine water pump having a detachable water pump reservoir.
Figure 2:
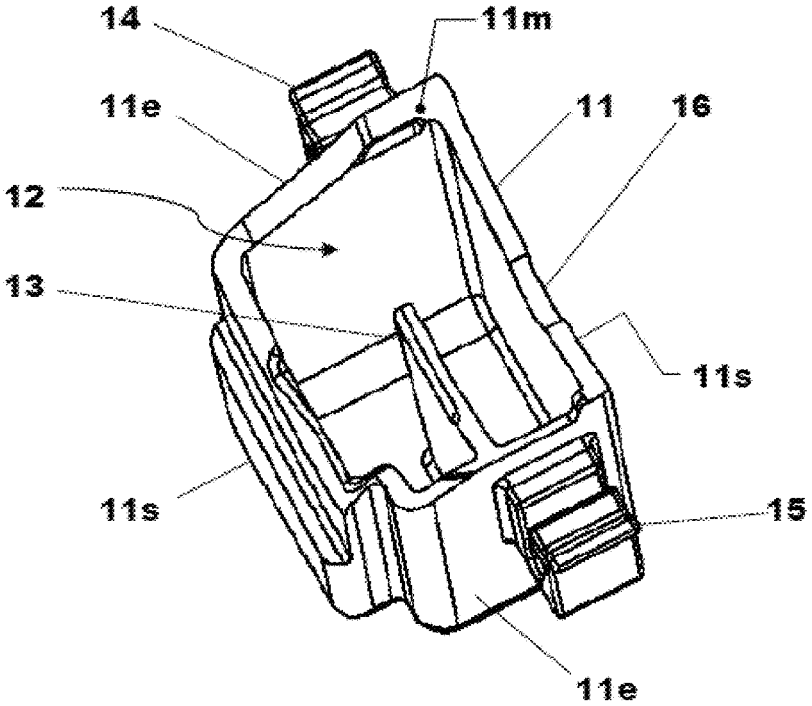
FIG. 2 is a pictorial plan view of a first embodiment of a detachable water pump reservoir included in the engine water pump in FIG. 1.

An improved engine water pump reservoir that overcomes previous engine water pump reservoir disadvantages is described herein. According to a first aspect of the engine water pump described herein there is provided a detachable water pump reservoir to collect coolant leakage from a housing of an engine water pump to which the reservoir is attached in use, the reservoir comprising a hollow body defining a chamber in which coolant leakage is collected and having a mouth shaped to complement a surface of the housing, at least one attachment apparatus to enable the reservoir to be easily and quickly attached to and removed from the housing of the water pump and a level indicator to indicate the level of the coolant collected in the reservoir.

The level indicator may include a cut-out in the mouth of the reservoir through which coolant can seep when the reservoir is full. Additionally or alternatively, the level indicator may be provided by using one of a translucent and a transparent plastic material for the reservoir through which the level of coolant in the reservoir can be viewed.

The level indicator may further comprise at least one of a mark and a line formed as part of the hollow body on a side of the reservoir that is visible when the reservoir is in use, the at least one of a mark and a line indicating when the coolant in the reservoir has reached a maximum desired level, in one example.

Alternatively, the level indicator may further comprise at least one of a mark and a line applied to the hollow body on a side of the reservoir that is visible when the reservoir is in use, the at least one of a mark and a line indicating when the coolant in the reservoir has reached a maximum desired level.

As yet a further alternative, the level indicator may be provided by an inspection window made from one of a translucent and a transparent plastic material in a side of the reservoir that is visible when the reservoir is in use and through which the level of coolant in the reservoir can be viewed.

The at least one attachment apparatus may include a twist and lock device enabling the reservoir to be easily and quickly attached to or removed from the housing of the water pump.

Alternatively, the at least one attachment apparatus may include clips enabling the reservoir to be easily and quickly attached to or removed from the housing of the water pump.

As yet another alternative, the at least one attachment apparatus may include a snap lock attachment apparatus enabling the reservoir to be easily and quickly attached to or removed from the housing of the water pump.

According to a second aspect of the engine water pump, the engine water pump includes a housing including a drain hole through which leakage of coolant from the housing of the water pump flows in use and a detachable water pump reservoir attached to the housing to collect any coolant leaking from the drain hole in the chamber of the reservoir.

The surface to which the reservoir is attached may have a shallow recess formed therein with which a mouth of the reservoir is engaged when it is attached to the water pump. The housing may have a cylindrical surface to which the reservoir is attached.

With particular reference to FIGS. 1 to 4 there is shown an engine water pump 5 of a motor vehicle having a housing 6 and a pump rotor 9. The housing 6 includes a cylindrical portion 6*n* to which a water pump reservoir 10 is attached on a lower portion thereof. The housing 6 encloses at least a portion of the pump rotor 9. The water pump reservoir 10 may be positioned vertically below the pump rotor 9.

A dynamic seal 8 is located in a bore of the housing 6 to seal between the housing 6 and the rotor 9 of the water pump 5. A chamber 8*c* is formed in the housing 6 inboard of the seal 8 and a drain hole 7 is provided in the cylindrical portion 6*n* of the housing 6 to allow coolant to escape from the chamber 8*c*. The term 'coolant' as meant herein is the liquid being circulated by the water pump 5. A ventilation channel 6*v* that is in communication with the chamber 8*c* is formed in an upper part of the housing 6.

The reservoir 10 has a hollow plastic body 11 defining a chamber 12 in which coolant leaking from the drain hole 7 is collected. The hollow body 11 has a pair of spaced apart end walls 11*e* and a pair of spaced apart side walls 11*s*. One of the side walls 11*s* remains visible when the reservoir is in position on the water pump 5. A baffle 13 is located in the chamber 12 to dampen oscillations in the coolant collected by the reservoir 10.

The upper ends of the side walls 11*s* and end walls 11*e* define a mouth 11*m* for the chamber 12. The mouth 11*m* is shaped so as to complement (e.g., conform to) a surface 6*c* on the cylindrical portion 6*n* of the housing 6 to which the reservoir 10 is attached so as to seal against the surface 6*c* when the reservoir 10 is in position on the water pump 5.

The upper ends of the side walls 11*s* therefore in this case have a concave part cylindrical shape to match the radius of the surface 6*c* of the housing 6 while the upper ends of the end walls 11*e* are shaped to match the longitudinal profile of the cylindrical portion 6*n* of the housing 6.

The surface 6*c* which in this case formed part of the cylindrical portion 6*n* and so is cylindrical may in some embodiments include a continuous shallow recess with which the upper ends of the side and end walls 11*s* and 11*e* of the hollow body 11 engage so as to reduce the risk of leakage at the interface between the reservoir 10 and the water pump 5.

The reservoir 10 is attached to the lower half of the cylindrical portion 6*n* by means of an attachment apparatus 14, 15; 21, 22 that allows the reservoir to be easily and quickly attached to or removed from the housing 6 of the water pump 5. The chamber 12 of the reservoir 10 is positioned when the reservoir 10 is in position on the water pump 5 so as to overlie the drain hole 7 so that any coolant escaping therefrom is trapped in the chamber 12.

The attachment apparatus includes in this case of a pair of flexible arms 14, 15 formed as integral parts of the reservoir 10 on opposite end walls 11*e* of the hollow body 11 for engagement with detents 21, 22 located on the housing 6 of the water pump 5 so as to attach the reservoir 10 to the housing 6 of the water pump 5. The flexible arms 14, 15 and the detents 21, 22 form in combination a snap lock attachment apparatus that enable the reservoir 10 to be easily and quickly attached to the water pump 5.

Figure 3A:
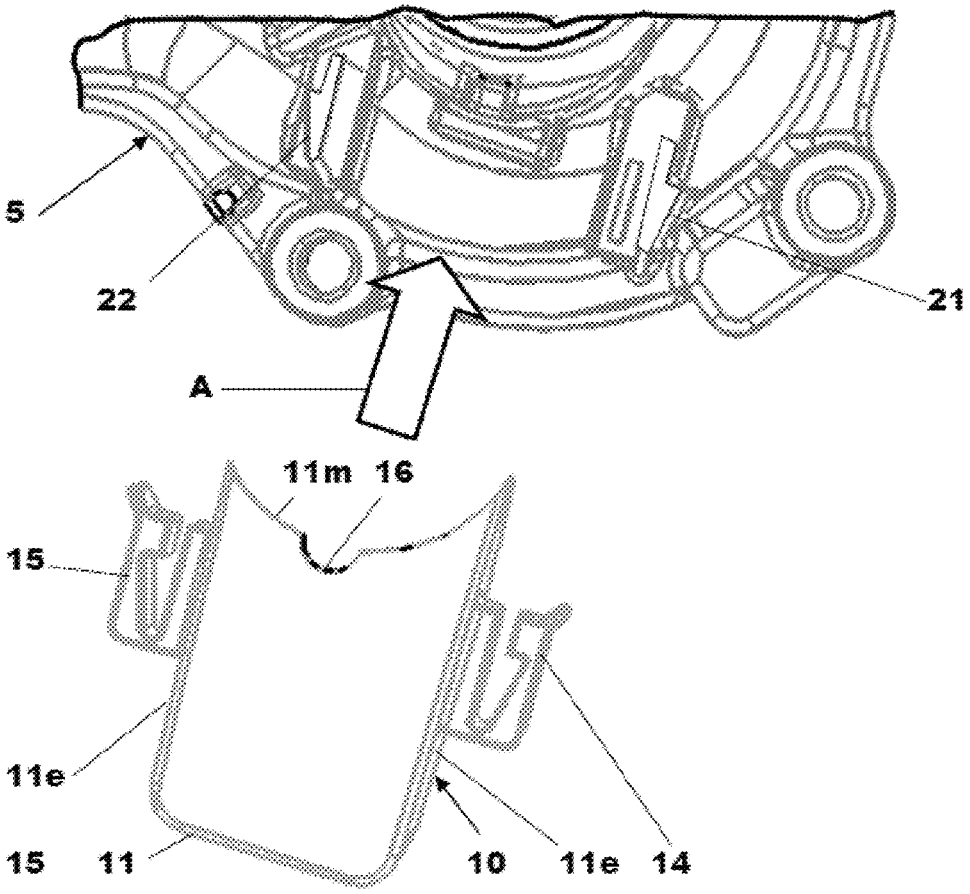
FIG. 3A is an exploded view showing the detachable water pump reservoir of FIGS. 1 and 2 during attachment of the reservoir to the water pump.
Figure 3B:
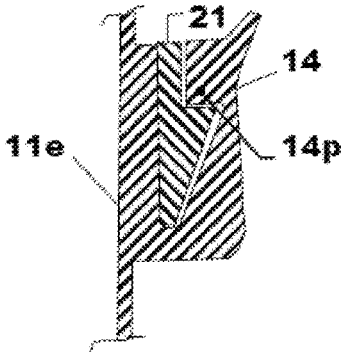
FIG. 3B is a scrap section on an enlarged scale showing the engagement of a flexible arm with a detent forming a snap-lock attachment apparatus.

As shown in FIG. 3*b* the flexible arm 14 has a projection 14*p* for engagement with the detent 21, the flexible arm 15 being similarly constructed.

Figure 3C:
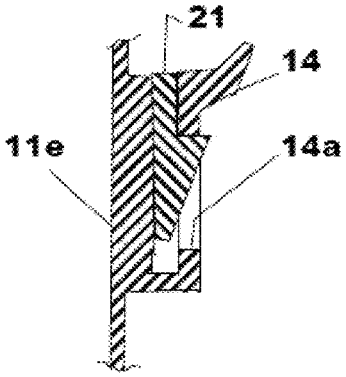
FIG. 3C is a scrap section on an enlarged scale showing the engagement of an alternative flexible arm with a detent forming a snap-lock attachment apparatus.
Figure 4:
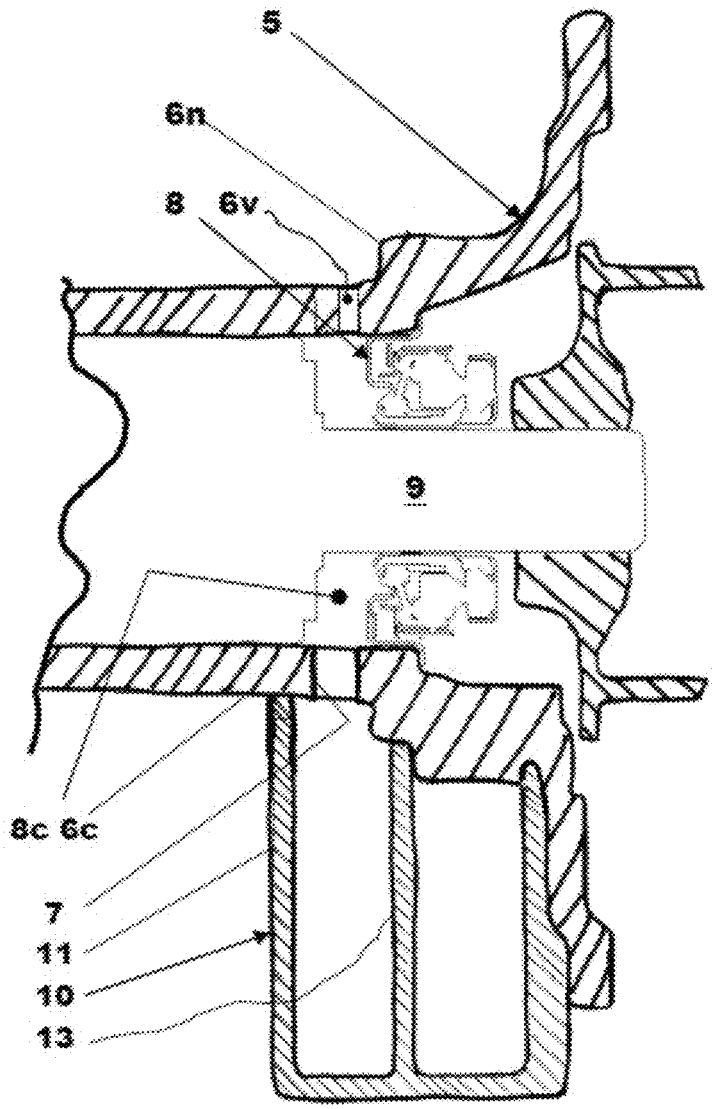
FIG. 4 is a scrap cross-section through part of the water pump shown in FIG. 1 showing the location of the reservoir on the water pump.

In FIG. 3*c* the flexible arm 14 is constructed so as to have an aperture 14*a* instead of a projection 14*p*. The detent 21 engages with the aperture 14*a* to form a snap lock attachment apparatus. As before the flexible arm 15 being similarly constructed. Specifically in the depicted example the detents taper towards one end. However, other detent geometries have been contemplated.

To attach the reservoir 10 to the water pump 5 it is offered up in the correct position and orientation and is then pushed upwards as indicated by the arrow A on FIG. 3 thereby bringing the flexible arms 14, 15 into engagement with the detents 21, 22 so as to attach the reservoir 10 to the housing 6 of the water pump 5. To remove the reservoir 10 from the water pump 5 the flexible arms 14, 15 are pulled away from the hollow body 11 so as to disengage them from the detents 21, 22 and the reservoir 10 can then be refracted in a downward direction (opposite to that shown by the arrow A on FIG. 3) from the water pump 5.

In this first embodiment the hollow body 11 of the reservoir 10 is made from an opaque plastic material and so, in order to provide an indication of when the reservoir 10 is full, a cut-out 16 is provided in the mouth 11*m* of the reservoir 10 in a side wall 11*s* of the reservoir 10 that remains visible when the reservoir 10 is attached to the water pump 5. Coolant can seep through the cut-out 16 when the reservoir is full providing an indication that the reservoir 10 needs to be replaced or emptied.

Use of the reservoir may be as follows, initially the reservoir 10 is attached to the water pump 5 as referred to above and there will be no coolant in the chamber 12. During use of the water pump 5, coolant may gradually leak via the drain hole 7 into the chamber 12 so that over time the chamber 12 fills with coolant. When the level of the coolant reaches the cut-out 16 it weeps out from the cut-out 16 providing an indication to an owner of the motor vehicle or to service representative that the reservoir 10 needs changing. The reservoir 10 can then be easily removed and either be replaced by a new reservoir or be emptied and be refitted to the water pump 5.

Figure 5:
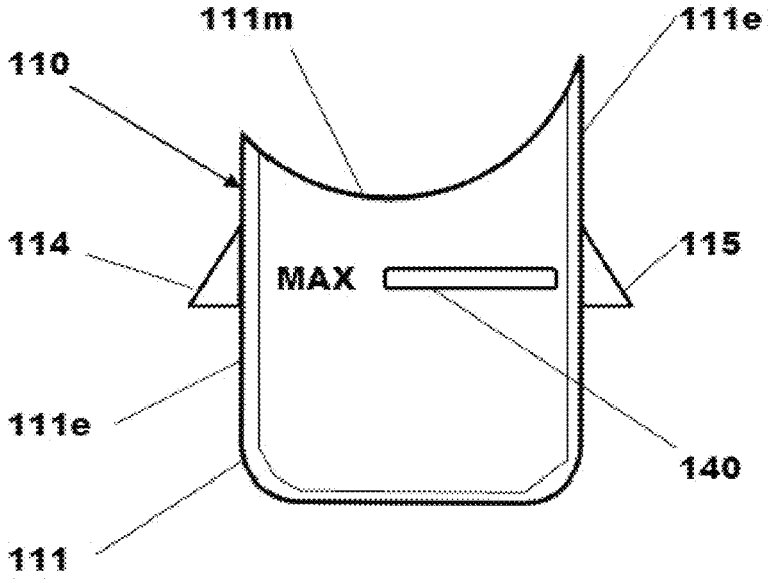
FIG. 5 is a front view of a second embodiment of a water pump reservoir that can be used instead of the water pump reservoir shown in FIGS. 1 to 4.

With reference to FIG. 5 a second embodiment of a water pump reservoir 110 is shown which in many respects is the same as that previously described and which as before is arranged to collect any coolant leaking out from the drain hole 7.

As before, the reservoir 110 has a hollow body 111 defining a chamber for collecting coolant that has leaked out of the water pump 5.

As before, part of an attachment apparatus is formed as an integral part of the end walls 111*e* of the hollow body 111 but in this case the attachment apparatus are in the form of a pair of detents 114, 115 which are arranged for engagement with flexible arms located on the housing 6 of the water pump 5. The detents 114, 115 and the flexible arms form in combination a snap lock attachment apparatus between the reservoir 110 and the water pump 5.

In this second embodiment the hollow body 111 of the reservoir 110 is made from one of a transparent and a translucent plastic material. Therefore, in order to provide an indication of when the reservoir 110 is full, a user or service representative merely has to view the reservoir 110 or to be more precise a part of the reservoir 110 that remains visible when the reservoir 110 is attached to the water pump 5 to provide an indication of the level of the coolant stored in the chamber of the hollow body 111.

As before, when the reservoir is full or has reached a predefined level the user or a service representative can simply replace the reservoir 110 with a new reservoir or empty the current reservoir 110 and refit it to the water pump 5.

To assist with assessing when to change the reservoir a level indicator can be provided such as the line 140 shown on FIG. 5. The line 140 can be formed as part of the hollow body 111 on a side of the reservoir 110 that is visible when the reservoir 110 is in use or can be applied to the side of the reservoir 110 that is visible when the reservoir 110 is in use by, for example, laser etching or painting. When the level of the coolant reaches the line 140, the user or service representative knows that it is time to replace the reservoir 110.

As an alternative to or as an addition to the a line 140 there could be a mark formed as part of the hollow body 111 on a side of the reservoir 110 that is visible when the reservoir 110 is in use or the mark can be applied to the side of the reservoir that is visible when the reservoir is in use by, for example, laser etching or painting. When the level of the coolant reaches the mark this provides an indication to the user or service representative that it is time to replace the reservoir 110. For example, the word "MAX" could be applied as a mark on the side of the reservoir 110 as shown in FIG. 5.

Figure 6:
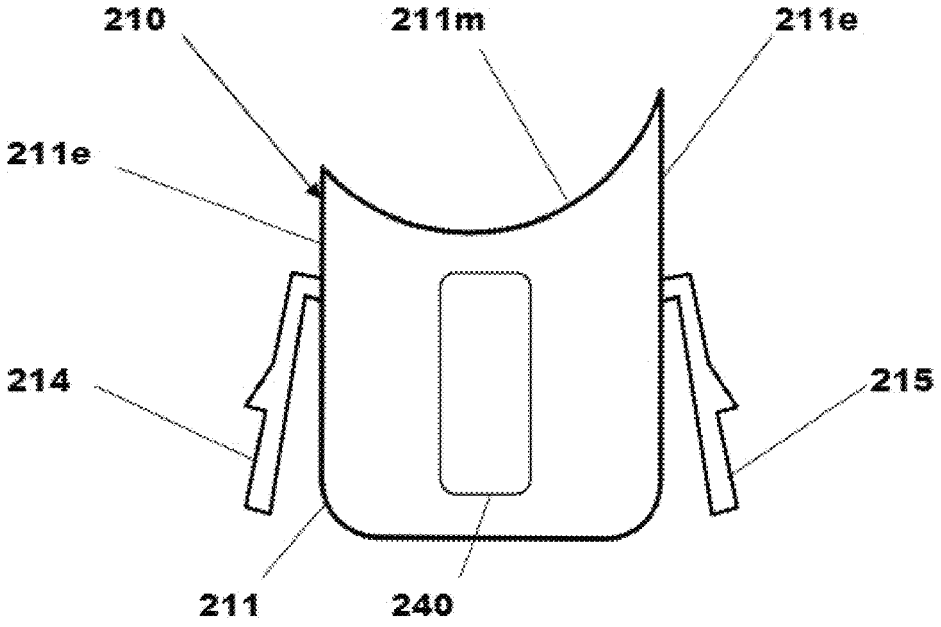
FIG. 6 is a front view of a third embodiment of a water pump reservoir that can be used instead of the water pump reservoir shown in FIGS. 1 to 4.

With reference to FIG. 6 a third embodiment of a water pump reservoir 210 is shown which in many respects is the same as that previously described and which as before is arranged to collect any coolant leaking out from the drain hole 7.

As before, the reservoir 210 has a hollow body 211 defining a chamber for collecting coolant that has leaked out of the water pump 5.

As before, part of an attachment apparatus is formed as an integral part of the end walls 211*e* of the hollow body 211 in the form of a pair of flexible arms 214, 215 that are arranged for engagement with detents located on the housing 6 of the water pump 5. The flexible arms 214, 215 and the detents, in combination, form a snap lock attachment apparatus between the reservoir 210 and the water pump 5. In this case, by squeezing the free ends of the two flexible arms 214, 215 towards the hollow body 211, the two flexible arms 214, 215 will result in the flexible arms 214, 215 disengaging from the detents on the housing 6 of the water pump 5 thereby allowing the reservoir 210 to be removed from the water pump 5.

In this third embodiment the hollow body 111 of the reservoir 210 is made from an opaque plastic material and so, in order to provide an indication of when the reservoir 210 is full, a translucent or transparent window 240 is fitted into a side wall of the reservoir 210 that remains visible when the reservoir 210 is in use on the water pump 5.

A user or service representative merely has to view the level of coolant in the reservoir 110 through the window 240 to receive an indication of the level of the coolant stored in the chamber of the hollow body 211.

As before, when the reservoir 210 is full or has reached a predefined level, the user or a service representative can simply replace the reservoir 210 with a new reservoir or empty the current reservoir 210 and refit it to the water pump 5.

It will be appreciated that the window 240 could include a line or mark as per the second embodiment shown in FIG. 5 to assist a user or service representative to decide when the reservoir 210 needs to be replaced or emptied.

FIGS. 1-6 provide for an engine water pump reservoir in an internal combustion engine comprising a hollow body defining a chamber in which coolant leakage is collected and having a mouth shaped to conform to a surface of a water pump housing enclosing a pump rotor, the coolant leakage emanating from a dynamic seal in the engine water pump, at least one attachment apparatus configured to be attached and removed from the housing of the water pump, and a level indicator on the hollow body indicating the level of the coolant collected in the reservoir.

FIGS. 1-6 also provide of the engine water pump reservoir further comprising a pair of flexible arms formed on an outer surface of the reservoir configured to engage detents in the water pump housing.

FIGS. 1-6 also provide of the engine water pump reservoir where the engine water pump reservoir is formed from a different material than the water pump housing. It will be appreciated that the water pump housing may be constructed out of a different material than the water pump reservoir due to different desired structural characteristics. As a result, the reservoir may be constructed out of a lighter and less expensive material, thereby reducing the cost and weight of the water pump. FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example.

A method for operating an engine of a vehicle, the engine having a water pump coupled in a cooling circuit of the engine pumping cooling through passages in the engine block, to a thermostate, and/or through a radiator. The water pump may include a detachable water pump reservoir collecting coolant leakage from a housing of the engine water pump to which the reservoir is attached. The reservoir may include a hollow body defining a chamber in which the coolant leakage is collected and having a mouth shaped to complement a surface of the housing; at least one attachment apparatus; and a level indicator to indicate the level of the coolant collected in the reservoir. The method may include indicating the level of coolant collected in the reservoir when pump is installed on the engine, and when the engine is positioned in the vehicle. The method may include seeping coolant through a seal into the reservoir, the level indicator include a cut-out in the mouth of the reservoir through which coolant seeps when the reservoir is full, wherein the level indicator is provided by using one of a translucent and a transparent plastic material for the reservoir through which the level of coolant in the reservoir can be viewed.

It will be appreciated that features from the various embodiments could be mixed so that, for example and without limitation, the attachment apparatus of the second embodiment could be used for the first or third embodiments without departing from the scope of the invention as defined by the appended claims.

It will be appreciated that the attachment apparatus can be any suitable means for enabling the easy and quick attachment of the reservoir to or removal of the reservoir from the water pump. Such as, for example, clips, snap-lock devices and twist and lock devices.

It will be appreciated that the surface to which the detachable water pump reservoir attaches does not need to be cylindrical or part cylindrical it could have another form.

It will be appreciated by those skilled in the art that although the invention has been described by way of example with reference to one or more embodiments it is not limited to the disclosed embodiments and that alternative embodiments could be constructed without departing from the scope of the invention as defined by the appended claims.

The subject matter of the present disclosure includes all novel and non-obvious combinations and sub-combinations of the various systems and configurations, and other features, functions, and/or properties disclosed herein.

The invention claimed is:

1. A detachable water pump reservoir to collect a coolant leakage from a housing of an engine water pump to which the detachable water pump reservoir is attached, the detachable water pump reservoir comprising:

a hollow body defining a chamber in which the coolant leakage emanating from a dynamic seal in the engine water pump is collected, where the hollow body has a mouth shaped to complement a surface of the housing of the engine water pump;

an attachment apparatus configured to enable the detachable water pump reservoir to be easily and quickly attached to and removed from the housing of the engine water pump; and a level indicator to indicate a level of the coolant leakage collected in the detachable water pump reservoir;

where the attachment apparatus includes a pair of flexible arms extending from opposing side walls of the detachable water pump reservoir and mating with a pair of detents in the housing of the engine water pump.

2. The detachable water pump reservoir of claim 1, wherein the level indicator comprises a cut-out in the mouth of the detachable water pump reservoir through which the coolant leakage can seep when the detachable water pump reservoir is full.

3. The detachable water pump reservoir of claim 1, wherein the level indicator is provided by using one of a translucent and a transparent plastic material for the detachable water pump reservoir through which the level of the coolant leakage in the detachable water pump reservoir can be viewed.

4. The detachable water pump reservoir of claim 3, wherein the level indicator further comprises at least one of a mark and a line formed as part of the hollow body on a side of the detachable water pump reservoir that is visible when coupled to an engine in a vehicle, the at least one of the mark and the line indicating when the coolant leakage collected in the detachable water pump reservoir has reached a maximum desired level.

5. The detachable water pump reservoir of claim 3, wherein the level indicator further comprises at least one of a mark and a line applied to the hollow body on a side of the detachable water pump reservoir that is visible, the at least one of the mark and the line indicating when the coolant leakage collected in the detachable water pump reservoir has reached a maximum desired level.

6. The detachable water pump reservoir of claim 1, wherein the level indicator is provided by an inspection window made from one of a translucent and a transparent plastic material in a side of the detachable water pump reservoir that is visible and through which the level of the coolant leakage collected in the detachable water pump reservoir can be viewed.

7. An engine water pump comprising:

a housing including a drain hole through which a coolant leakage flows, where the coolant leakage emanates from a dynamic seal; and a detachable water pump reservoir removably attached to the housing to collect the coolant leakage from the drain hole in a chamber of the detachable water pump reservoir, the detachable water pump reservoir including;

a hollow body defining the chamber in which the coolant leakage is collected, where the hollow body has a mouth shaped to complement a surface of the housing;

an attachment apparatus configured to enable the detachable water pump reservoir to be easily and quickly attached to and removed from the housing of the engine water pump; and a level indicator to indicate a level of the coolant leakage collected in the detachable water pump reservoir;

where the attachment apparatus includes a pair of flexible arms extending from opposing side walls of the detachable water pump reservoir and mating with a pair of detents in the housing of the engine water pump; and where the surface to which the detachable water pump reservoir is attached has a shallow recess formed therein with which the mouth of the detachable water pump reservoir is engaged when it is attached to the engine water pump.

8. The engine water pump of claim 7, wherein the housing has a cylindrical surface to which the detachable water pump reservoir is attached.

9. An engine water pump reservoir, comprising:

a hollow body defining a chamber in which a coolant leakage is collected, where the hollow body has a mouth shaped to conform to a surface of a water pump housing enclosing a pump rotor, and where the coolant leakage emanates from a dynamic seal in an engine water pump;

an attachment apparatus removably attached to the water pump housing, where the attachment apparatus includes a pair of flexible arms extending from opposing side walls of the engine water pump reservoir and mating with a pair of detents in the water pump housing; and a level indicator on the hollow body indicating a level of the coolant leakage collected in the engine water pump reservoir;

where the surface to which the detachable water pump reservoir is attached has a shallow recess formed therein with which the mouth of the detachable water pump reservoir is engaged when it is attached to the engine water pump.

10. The engine water pump reservoir of claim 9, where the engine water pump reservoir is formed from a different material than the water pump housing.

* * * * *